US009354020B1

(12) United States Patent
Wong et al.

(10) Patent No.: US 9,354,020 B1
(45) Date of Patent: May 31, 2016

(54) DUAL COMPRESSION SPRING PROJECTILE LAUNCHER

(71) Applicant: Mattel, Inc., El Segundo, CA (US)

(72) Inventors: Chun Wing (Edward) Wong, Kowloon (HK); Kin Fai (Edmund) Chang, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/644,385

(22) Filed: Mar. 11, 2015

Related U.S. Application Data

(60) Provisional application No. 61/951,639, filed on Mar. 12, 2014.

(51) Int. Cl.

| | |
|---|---|
| ***F41B 11/642*** | (2013.01) |
| ***F41B 11/646*** | (2013.01) |
| ***F41B 7/08*** | (2006.01) |
| ***F41B 11/89*** | (2013.01) |

(52) U.S. Cl.
CPC ..... *F41B 11/646* (2013.01); *F41B 11/89* (2013.01)

(58) Field of Classification Search
CPC ..... F41B 7/00; F41B 7/003; F41B 7/043; F41B 7/04; F41B 7/046; F41B 7/08; F41B 11/642; F41B 11/646; F41B 11/89; F41B 11/14
USPC ..... 42/54; 124/66, 67, 68, 27, 28, 76, 65
See application file for complete search history.

(56) References Cited

U.S. PATENT DOCUMENTS

| | | | | | |
|---|---|---|---|---|---|
| 723,227 | A * | 3/1903 | Anthony | F41B 7/003 | 124/2 |
| 1,503,913 | A * | 8/1924 | Miles | F41B 11/647 | 124/37 |
| 3,004,533 | A * | 10/1961 | Ritz | F41B 7/04 | 124/27 |
| 4,367,723 | A * | 1/1983 | Resuggan | F41B 11/646 | 124/67 |
| 4,732,136 | A * | 3/1988 | Ferri | F41B 11/646 | 124/67 |
| 4,774,929 | A * | 10/1988 | Milliman | F41A 3/58 | 124/76 |
| 4,843,751 | A * | 7/1989 | Ferri | F41B 11/55 | 124/67 |
| 5,775,312 | A * | 7/1998 | Wilkinson | F41B 11/642 | 124/67 |

(Continued)

*Primary Examiner* — Bret Hayes
*Assistant Examiner* — Derrick Morgan
(74) *Attorney, Agent, or Firm* — Edell, Shapiro & Finnan, LLC

(57) ABSTRACT

A projectile launcher includes a housing including a launching section. The launching section includes a first spring and a second spring, a piston coupled with the first and second springs, and a charger that compresses each of the first and second springs against the piston within the launching section. The projectile launcher further includes hollow barrel that extends to a front end of the projectile launcher, a projectile loading area configured to receive and load a projectile in position with a firing end of the piston and the barrel, and a trigger. Compression of the first and second springs by the charger is released in response to actuation of the trigger, where release of the compression of the first and second springs forces movement of the piston toward the projectile loading area so as to launch a projectile loaded within the projectile loading area through the barrel and from the projectile launcher.

11 Claims, 8 Drawing Sheets

(56) References Cited

U.S. PATENT DOCUMENTS 5,979,424 A * 11/1999 Alvarez ..... F41B 7/08 124/16
6,003,503 A * 12/1999 Johnson ..... F41B 9/0018 124/69
D514,173 S * 1/2006 McBride ..... D21/572
7,191,775 B1 * 3/2007 Lo ..... F41A 11/00 124/65
7,658,302 B2 * 2/2010 Berman ..... F41B 9/0018 124/66
8,104,395 B2 * 1/2012 Ran ..... F41H 5/12 89/36.06
8,800,541 B2 * 8/2014 Hu ..... F41A 33/06 124/32
2006/0191523 A1 * 8/2006 Paletz ..... F41B 11/51 124/67
2010/0065033 A1 * 3/2010 Yang ..... F41B 11/646 124/66
2011/0146645 A1 * 6/2011 Ma ..... F41B 11/64 124/59
2012/0037135 A1 * 2/2012 Dakan ..... F41B 7/006 124/16
2014/0165983 A1 * 6/2014 Busse ..... F41B 11/89 124/66
2014/0326228 A1 * 11/2014 Poirier ..... F41B 7/08 124/16

* cited by examiner

DUAL COMPRESSION SPRING PROJECTILE LAUNCHER

CROSS REFERENCE TO RELATED APPLICATION

The present application is a is a non-provisional of U.S. Provisional Application No. 61/951,639, entitled "Dual Compression Spring Projectile Launcher" and filed 12 Mar. 2014, the disclosure of which is incorporated herein by reference in its entirety.

FIELD OF THE INVENTION

The present invention relates to a toy projectile launcher.

BACKGROUND OF THE INVENTION

Various toy gun products exist that are configured to fire or launch single or multiple darts or other types of toy projectiles. The toy gun products can particularly be enhanced to provide multiple firing capabilities of toy projectiles.

It would be desirable to provide a projectile launcher capable of launching projectiles at suitable distances while being easy to operate.

SUMMARY OF THE INVENTION

In one embodiment, a projectile launcher comprises a housing including a launching section. The launching section comprises a first spring and a second spring, a piston coupled with the first and second springs, and a charger that compresses each of the first and second springs against the piston within the launching section. The projectile launcher further comprises hollow barrel that extends to a front end of the projectile launcher, a projectile loading area configured to receive and load a projectile in position with a firing end of the piston and the barrel, and a trigger. Compression of the first and second springs by the charger is released in response to actuation of the trigger, where release of the compression of the first and second springs forces movement of the piston toward the projectile loading area so as to launch a projectile loaded within the projectile loading area through the barrel and from the projectile launcher.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF THE INVENTION

A projectile launcher includes a dual spring compression launching structure that effectively launches projectiles great distances (e.g., as far as 85 feet or even greater distances). The dual spring compression launching structure is easy to load using s charging lever that is pulled back and then pushed forward in a manner described herein prior to launching each projectile. The projectile launcher can further include a detachable front section including a handle that, when operated, pivots the front section to a position that opens up and serves as a shield for the projectile launcher.

Figure 1:
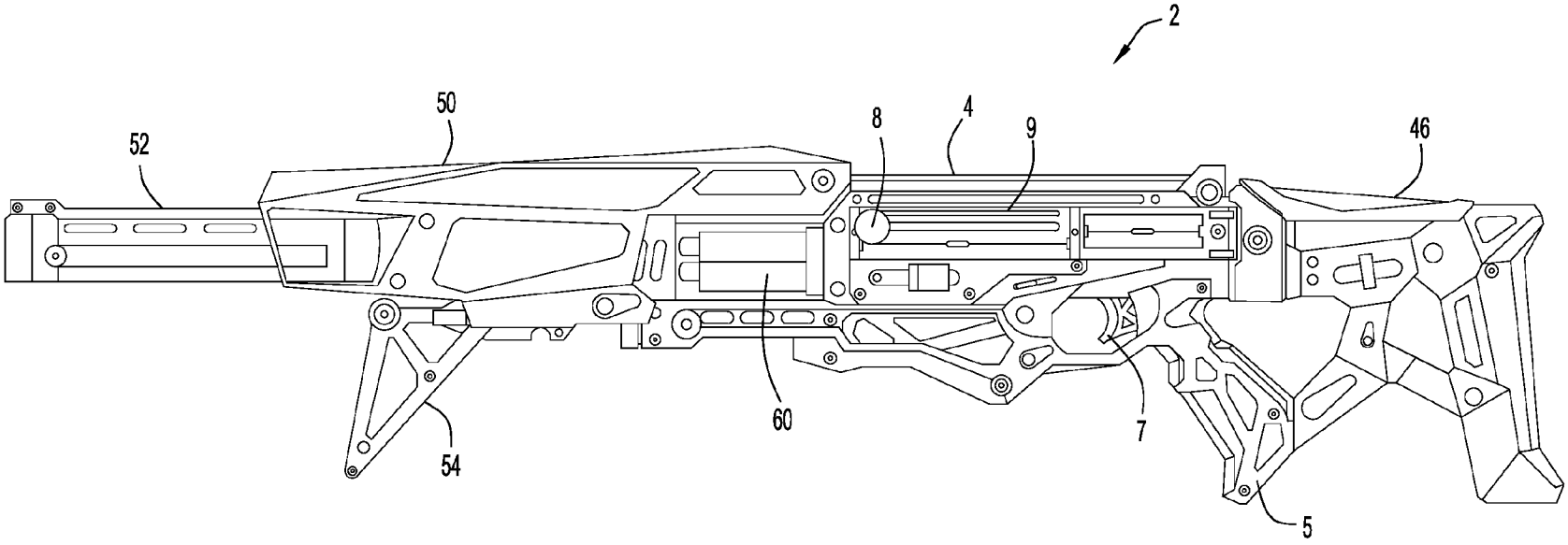
FIG. 1 depicts a side view in elevation of a projectile launcher including a dual spring compression to facilitate long range launching of projectiles according to an example embodiment of the present invention.
Figure 2:
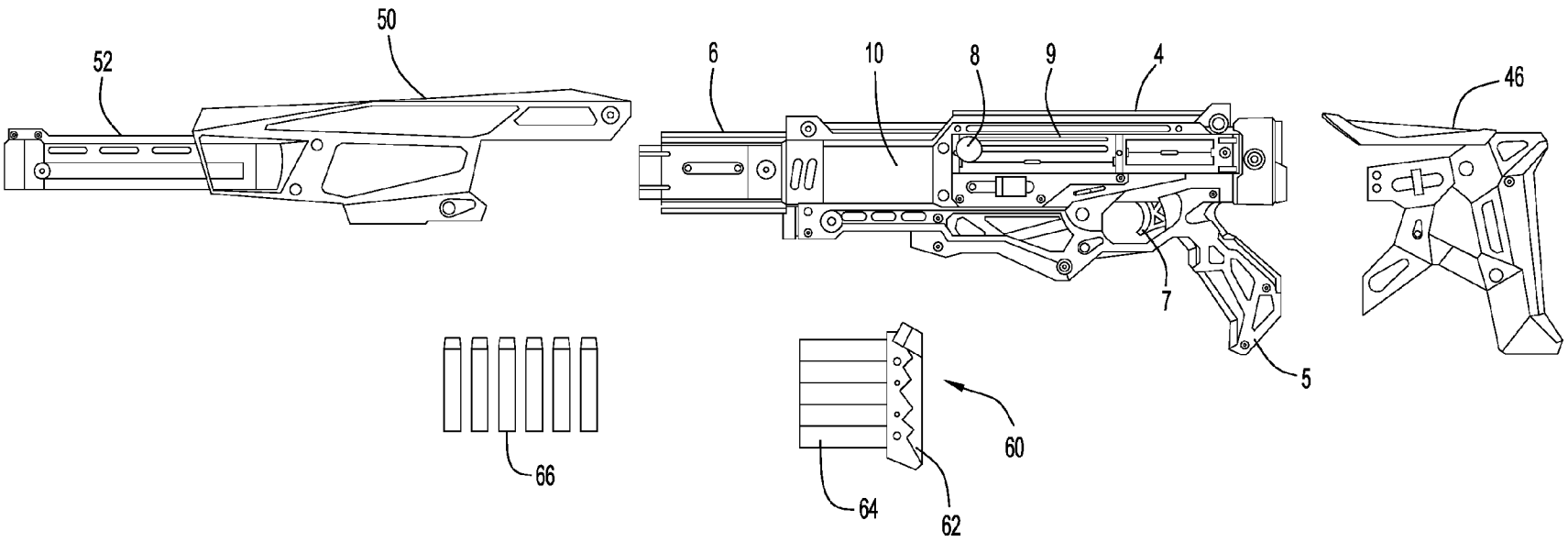
FIG. 2 depicts an exploded side view in elevation of the projectile launcher of FIG. 1.

An example embodiment of a projectile launcher 2 is depicted in FIGS. 1 and 2, where FIG. 2 provides an exploded view of the launcher 2 showing a separation of different components. Each of the components, unless specifically described otherwise herein, can be constructed of any suitable materials (e.g., plastics, metals, etc.) that facilitate suitable operation of the launcher 2 as described herein. The projectiles are preferably constructed of a suitable lightweight material that is safe for use in various types of gaming or play scenarios. For example, a projectile can comprise a dart having a soft (e.g., foam) exterior and a blunt end that facilitates suitable aerodynamic flight characteristics of the projectile while also ensuring relatively safe play scenarios when the dart is fired by the launcher at a target.

The projectile launcher 2 includes a central section 4 that houses a projectile magazine 60 and includes a hollow main barrel 6 at a front end of the central section 4 and launching structure 20 (depicted in the cross-sectional views of FIGS. 5, 6, 7A and 7B) disposed within a central portion of the central section 4. A butt or rear portion 46 connects at a rear end of the central section 4 (i.e., the rear end opposes the front end in a lengthwise or longitudinal direction of the central section 4). A detachable front section 50 is provide at the front end of the central section 4 and connects with the main barrel 6.

A handle 5 extends from a lower portion near a second end of the central section 4. The handle 5 provides a gripping surface for a user to effectively hold and aim the launcher 2, e.g., while the rear portion 46 is proximate or adjacent the user's body, during operation of the launcher 2. A trigger 7 is also disposed at a lower portion of the central section 4 and is coupled with the launching structure 20 in a manner as described herein to facilitate firing or launching of projectiles 66 loaded within a magazine 60 from the main barrel 6 during operation of the launcher 2.

The magazine 60 includes a base 62 and a plurality of elongated projectile chambers 64, each of which is configured to house a projectile 66. The magazine 60 and launcher 2 can be configured such that the magazine is rotated in relation to the central section 4 during operation to facilitate advancement of the next projectile 66 into position for firing through the main barrel 6 after a previous projectile 66 has been fired. While the example embodiment depicts a magazine 60 configured to house a total of six projectiles 66, it is noted that the launcher 2 can be configured with a magazine that contains any selected number of projectiles (e.g., more or less than six projectiles). The magazine 60 fits within an opening within the central section 4 directly behind the main barrel 6.

Figure 3A:
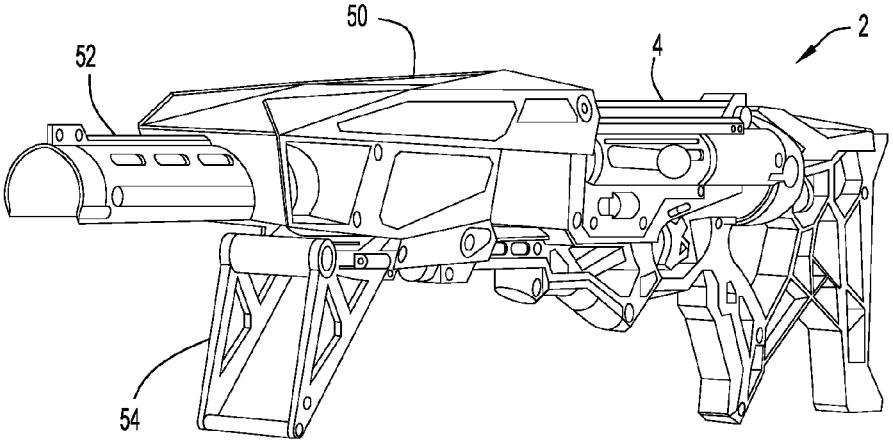
FIGS. 3A and 3B depict views in perspective of the projectile launcher of FIG. 1 showing operation of a detachable front section that is configured to transition from a first position adjacent the launcher to a second position oriented away from the launcher.
Figure 3B:
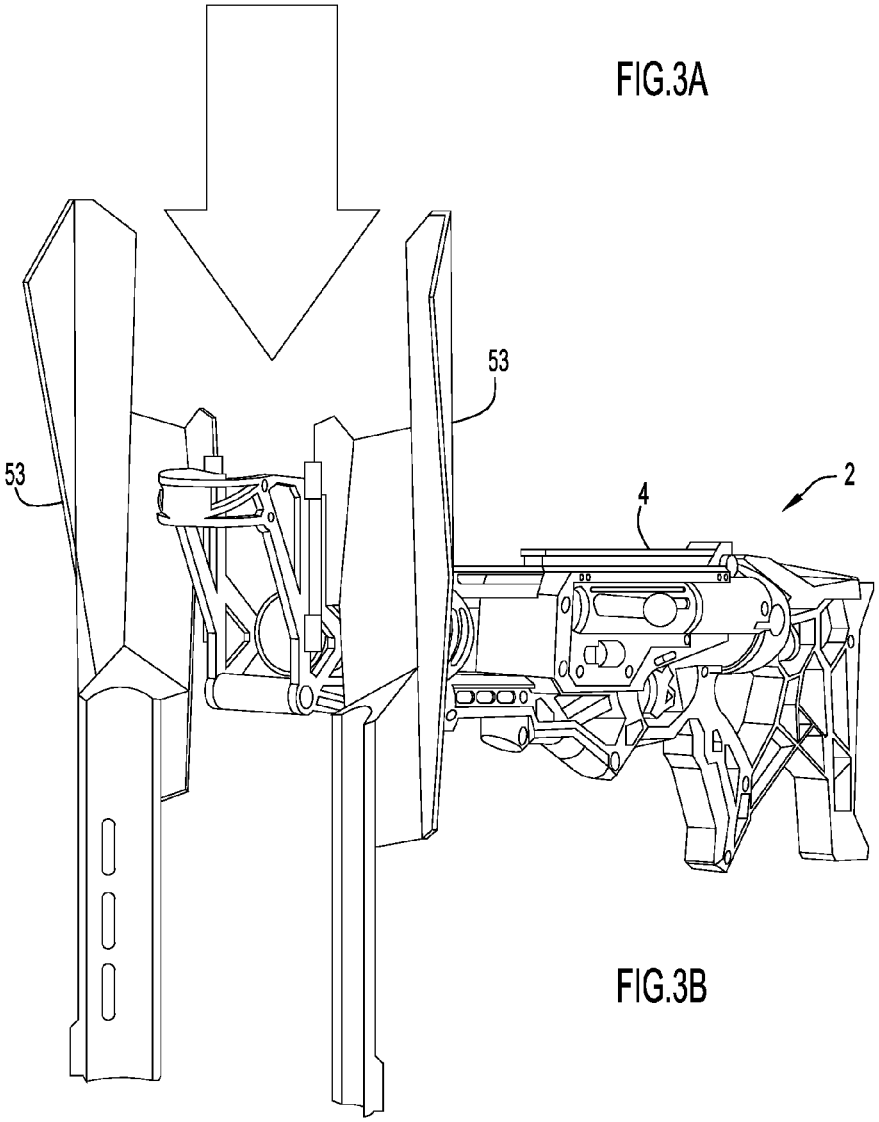

Referring to FIGS. 1, 3A and 3B, the detachable front section 50 includes an extended hollow barrel section 52 that connects with the main barrel section 6 of the central section 4. The extended hollow barrel section 52, when aligned in a first position as depicted in FIG. 3A, is substantially coaxial with the main barrel section 6 so as to extend the barrel of the projectile launcher 2 (i.e., a projectile 66 fired by the launcher 2 and travelling through the main barrel section 6 also travels through the extended hollow barrel section 52 when it is aligned as depicted in FIG. 3A). Extending at a lower position from the extended barrel section 52 is a handle 54. The hollow barrel section 52 is further pivotally connected with the main barrel section 6 such that, when the handle 54 is pulled in a direction down and away from a front end of the main barrel section 6, the barrel section 52 is moved into a second position and can be divided into two generally symmetrical sub-sections 53 that are aligned transverse the lengthwise dimension of the main barrel section 6 as depicted in FIG. 3A. In this second position, in which sub-sections 53 are spread apart from each other and oriented transverse the main barrel section 6, the extended barrel section 52 can serve as a shield at the first or front end of the launcher 2, while allowing exposure to the open front end of the main barrel section 6 (thus allowing projectiles 66 to still be fired from the launcher when the detachable front section 50 is in the second, shield-forming position).

Figure 4:
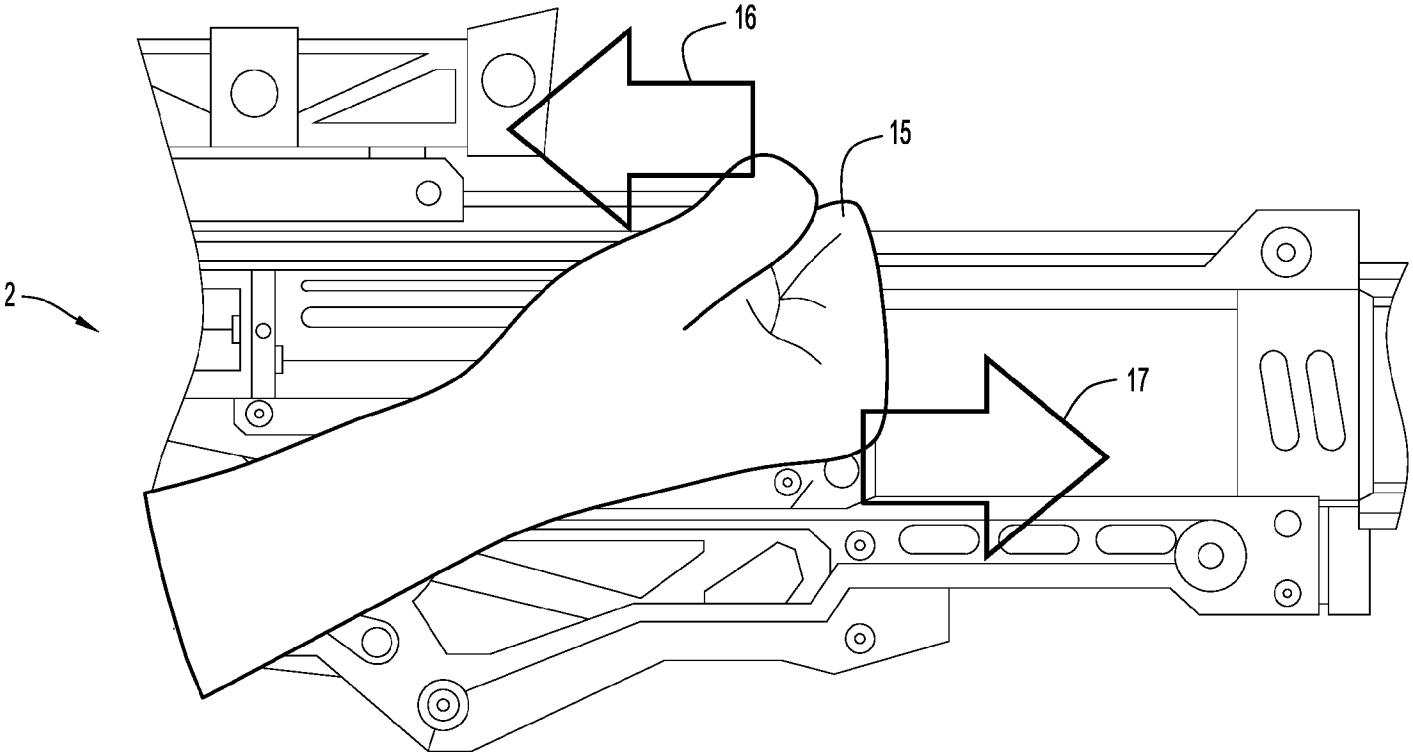
FIG. 4 depicts a partial side view in elevation of the projectile launcher of FIG. 1 in which a charging lever of the projectile launcher is operated by a user to charge the launcher prior to launching a projectile.

Referring to FIGS. 1, 2 and 4, the central section 4 further includes a charging lever 8 that is configured to move within a slot 9 formed along a lengthwise direction of the central section 4. As shown in FIG. 4, and as further described herein, a user (e.g., using hand 15) grips the charging lever 8 to compresses first and second springs within the launching structure 20 and thus "load" the launcher 2 for firing a projectile by first pulling back the charging lever 8 within slot 9 (in the direction of arrow 16) and then pushing forward the charging lever 8 within slot 9 (in the direction of arrow 17).

The dual compression loading of the launcher 2 is achieved by operation of the launching structure 20 within the central section 4 which is depicted in FIGS. 5, 6, 7A and 7B. The launching structure 20 includes a carriage 22 including a shaft 24 that extends transversely from the carriage 22 and couples with the charging lever 8 to facilitate movement of the carriage 22 in correspondence with movement of the charging lever 8 when the charging lever is pulled back and pushed forward as depicted in FIG. 4.

The launching structure 20 also includes an elongated piston rod 26 that is aligned in close proximity with the carriage 22 to facilitate engagement with portions of the carriage 22 which facilitates movement of the piston rod 26 during pulling back movement of the charging lever 8 as described herein. The piston rod 26 includes a front firing end 28 that provides propulsion force to a projectile 66 loaded with a cartridge chamber 64 when the chamber 64 is aligned with the main barrel 6. A carriage engaging member 30 is defined at a widened portion of the piston rod 26 a distance from the firing end 28 and is configured to engage with a portion of the carriage 22 near the carriage shaft 24. Extending from the carriage engaging member 30 toward the second end of the central section 4 are a first spring support 32 and a second spring support 33. A first spring 40 extends around the first spring support 32, and a second spring 42 extends around the second spring support 33. The first and second spring supports 32, 33 are offset from each other such that an axis along which each spring 40, 42 is compressed is different. However, the connection of the first and second spring supports 32, 33 with member 30 results in the compression forces from both springs 40, 42 being combined to act upon the piston rod 26 when the launching structure 20 is loaded or charged as described herein. Locking apertures 35 are disposed at a rear end of the first spring support and are configured to lock the piston rod 26 against the bias of springs 40 and 42 during loading of the launching structure 20 as described herein.

A locking plate 11 is located at the second end of the central structure 4 and includes one or more engaging fingers 13 that engage in a locking engagement with the locking apertures 35 of the first spring support 32 when the piston rod 26 is moved toward the second end of the central structure 4. The locking plate 11 is coupled with the trigger 7 to facilitate release of the locking engagement of the engaging fingers 13 with the locking apertures 35.

Figure 5:
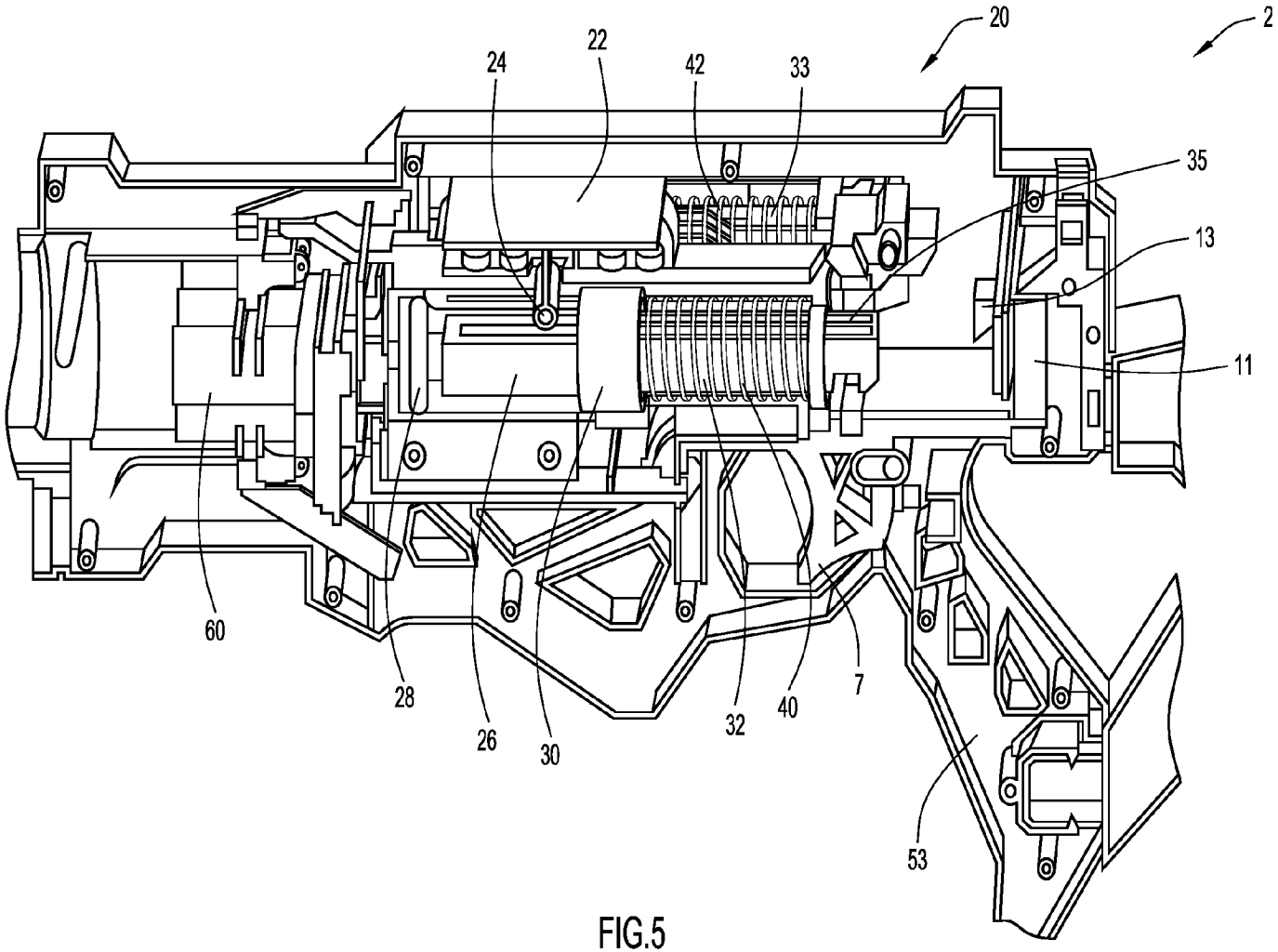
FIG. 5 depicts a partial cross-sectional side view in elevation of the projectile launcher of FIG. 1 in which the projectile launching structure is in an original position (prior to charging of the projectile launching structure).

During operation of the projectile launcher 2 to load the launching structure 20, a user installs the magazine 60 (loaded with one or more projectiles 66 within chambers 64) within an opening defining a projectile loading area 10. Alternatively, the magazine 60 may already be installed within (e.g., and non-removable from) the projectile loading area 10, where projectiles 66 may be loaded within chambers 64 while the magazine 60 is installed. In an original or start position, as depicted in FIGS. 1 and 5, the charging lever 8 is located at or near a furthest position within the slot 9 that is closest to the front end of the central section 4. In this position, the piston rod 26 is also positioned within and biased by the first spring 40 (which is located around first spring support 32) toward the front end of the central section 4 such that the firing end 28 is at its closest position to the projectile magazine 60.

The user, while holding the launcher 2 (e.g., by the handle 5) pulls the charging lever 8 back toward the rear end of the central section 4 (as shown by arrow 16 in FIG. 4). This results in movement of the carriage 22 back toward the rear end of the central section 4 in correspondence with the pulling back of the charging lever 8. A portion of the carriage 22, during its backward movement, engages with the carriage engaging member 30 of the piston rod 26 and forces movement of the piston rod 26 toward the rear end of the central section 4 against the bias of the first spring 40.

The movement of the piston rod 26 caused by the pull back of the charging lever 8 further results in a compression of the first spring 40. In particular, a rear end of the first spring 40 is prevented from moving back toward the rear end of the central section 4 due to its abutting engagement with a stop structure provided within the launching structure 20 in alignment with the rear end of the first spring 40. When the piston rod 26 is moved toward the rear end of the central section 4, the carriage engaging member 30 engages with a front end of the first spring 40, thus compressing the first spring 40 during such piston rod movement.

As the rear end of the piston rod 26 approaches the rear ends of both the slot 9 and the central section 4, the engaging fingers 13 of the locking plate 11 engage within the locking apertures 35 of the rear end of the piston rod 26. The engagement of the engaging fingers 13 within the locking apertures 35 effectively holds the piston rod 26 in the position depicted in FIG. 6 against the bias of the first spring 40, which is now fully compressed. Thus, the piston rod 26, including first and second spring supports 32, 33, are effectively locked in place by the locking plate 11.

Compression of the second spring 42 is achieved by pushing the charging lever 8 from its position at the rear end of slot 9 toward the front ends of both the slot 9 and the central section 4 (in the direction of arrow 17 as depicted in FIG. 4). During such forward movement of the charging lever 8, the carriage 22 also moves in correspondence with the charging lever 8.

Figure 6:
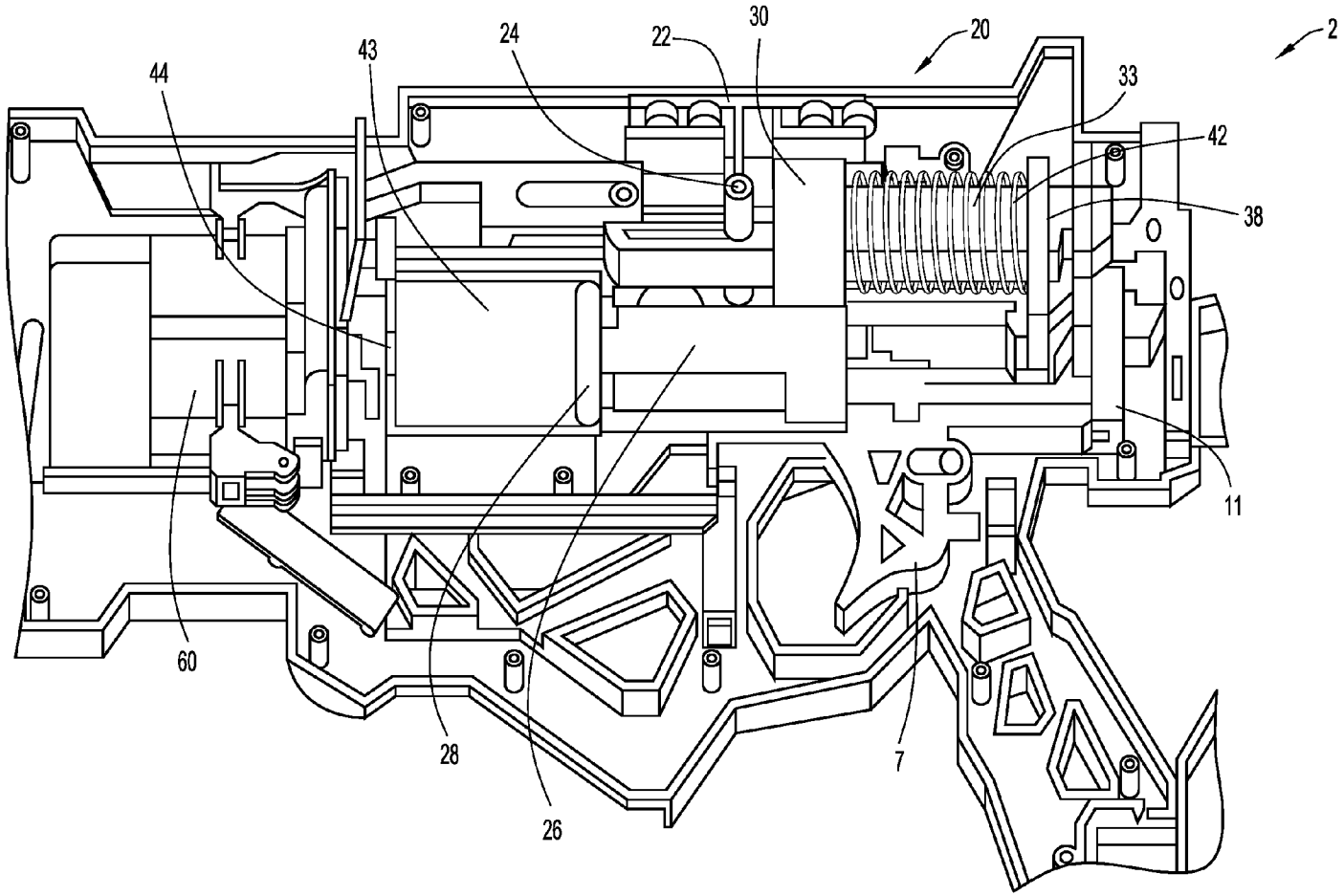
FIG. 6 depicts a partial cross-sectional side view in elevation of the projectile launcher of FIG. 1 after operation of the projectile launching structure by a pull back movement of the charging lever to compress a first spring.
Figure 7A:
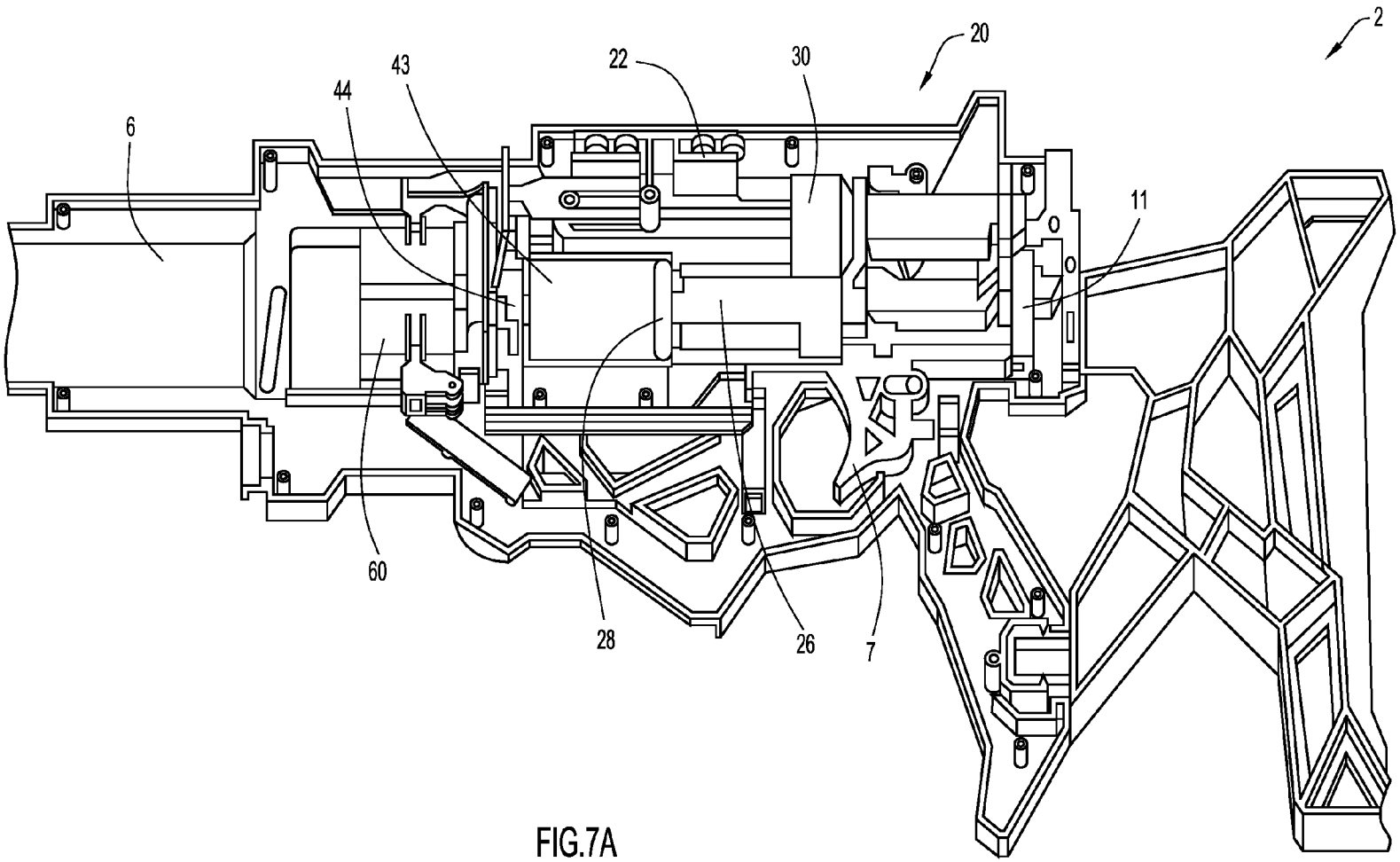
FIGS. 7A and 7B are partial cross-sectional side views in elevation of the projectile launcher of FIG. 1 after operation of the projectile launching structure by a push forward movement of the charging lever to compress a second spring.
Figure 7B:
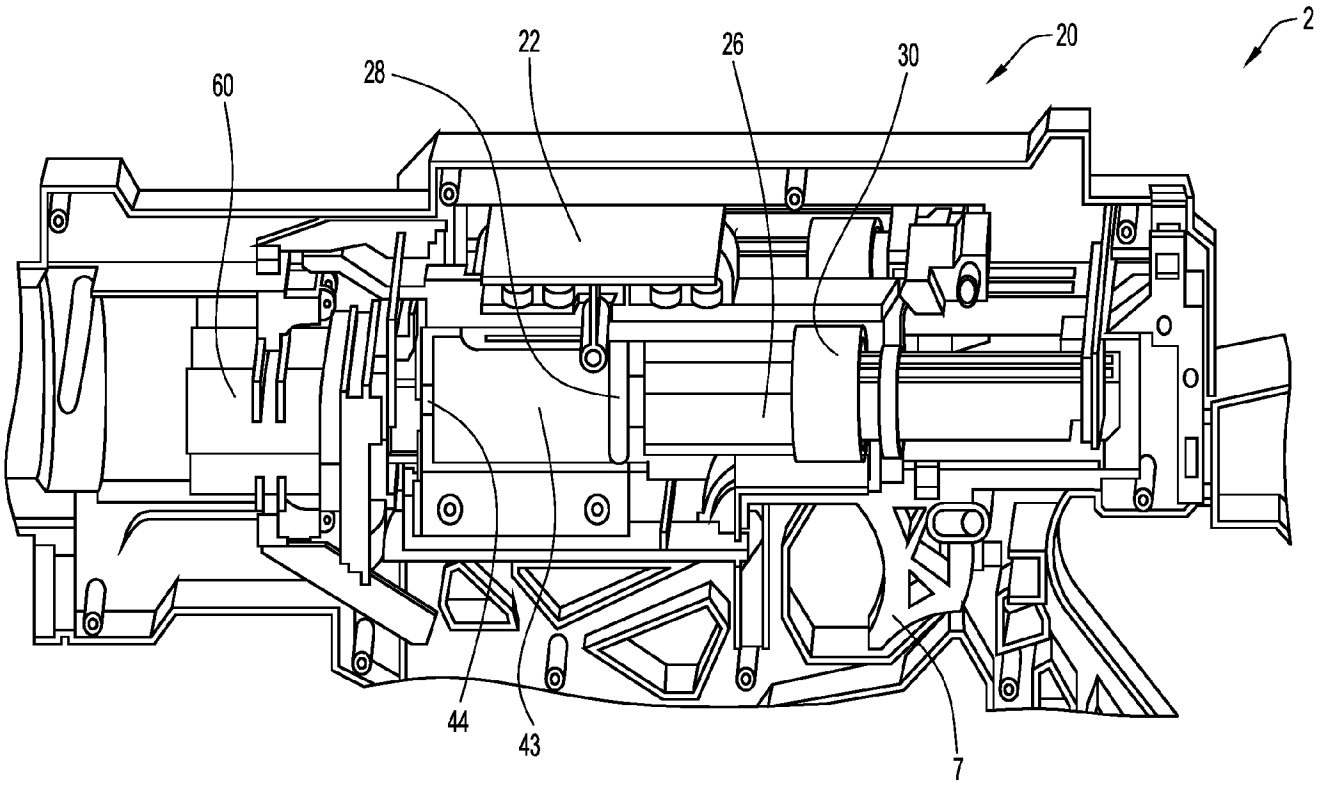

As previously noted, the piston rod 26, including spring supports 32, 33, is locked in position due to the locking engagement with the locking plate 11 and thus cannot move forward with the carriage 22. The forward movement of the carriage 22 combined with the locked position of the piston rod 26 results in compression of the second spring 42. In particular, a rear end portion 38 of the carriage 22 (as depicted in FIG. 6) engages with a rear end of the second spring 42, while a front end of the second spring 42 engages the carriage engaging member 30. A forward movement of the carriage 22, without movement of the locked piston rod 26, causes compression of the second spring between the carriage rear end portion 38 and the carriage engaging member 30. When the charging lever 8 is moved to its further position in the direction toward the front ends of both the slot 9 and the central section 4, the second spring 42 is fully compressed, as depicted in FIGS. 7A and 7B. Further, the charging lever 8 and carriage 22 can be locked in the forward position to prevent its backward movement toward the rear end of the central section 4 due to the bias of the compressed second spring 42.

With the dual compression of the first and second springs 40, 42, the projectile launcher 2 provides an effective propulsion force to a projectile 66 that is transmitted from the piston rod 26 when the trigger 7 is pulled by the user. In particular, pulling of the trigger 7 by the user causes a movement of the locking plate 11 (which is coupled to the trigger 7) and release of the engaging fingers 13 from the locking apertures 35 at the rear end of the piston rod 26. The release of such locking engagement results in a forced and rapid movement of the piston rod 26, based upon the bias of the compressed first and second springs 40 and 42 against the carriage engaging member 30, such that the firing end 28 of the piston rod 26 is propelled toward the magazine 60 and a projectile 66 loaded within a magazine chamber 64 aligned with the main barrel 6. The rapid movement of the piston rod 26 toward the front end of the central section 4 results in a transmission of a force transmitted from the piston firing end 28 to the projectile 66, which launches the projectile 66 through the main barrel 6 (and through the extended barrel section 52, when the detachable front section 50 is in the first position in relation to the central section 4) and outward from the launcher 2. In particular, a front portion of the piston rod 26 that includes the piston firing end 28 extends during movement within an air chamber 43 that includes a smaller aperture 44 at its front end, where the aperture 44 is in alignment with a chamber 64 of the magazine 60. The base 62 of the magazine includes openings that correspond and communicate with the chambers 64 to provide an airflow path from the air chamber 43, via its aperture 44, to a projectile 66 loaded within a magazine chamber 64 aligned with the air chamber 43. Rapid movement of the piston rod 26 within the air chamber 43 toward the front end of the central section 4 forces a flow or plug of air within chamber 43 through the aperture, which in turn provides a propelling force that ejects the projectile 66 from the barrel 64 and launches it through the main barrel 6 and from the launcher 22.

The completion of the movement of the piston rod 22 toward the front end of the central section 22 results in the launching structure 20 having its original or starting configuration as depicted in FIG. 5, where the dual compression on the first and second springs 40, 42 caused by the loading or charging action of the charging lever is released.

The user simply repeats the above actions, with a pull back then push forward of the charging lever 8 in order to re-load or re-charge the launching structure 20 such that both the first and second springs 40, 42 are again compressed and set to release their spring biasing force upon the piston rod 26 in response to actuation of the trigger 7. It is further noted that movement of the charging lever 8 from its rear position to the forward position (i.e., movement in the direction of arrow 17 as depicted in FIG. 4) results in a movement of the magazine 60 (e.g., rotational movement of the carriage) such that the next barrel 64 housing a projectile 66 is aligned with the piston rod 26 and the main barrel 8.

Thus, the dual spring compression provided by the launching structure 20 of the launcher 2 provides an effective propulsion force to a projectile 66 loaded within the magazine 60. The combined compressed spring biasing force by springs 40 and 42 acting on the piston rod 26 results in a greater firing power for the launcher 2.

During operation of the launcher 2, the user can also decide to convert the detachable front section 50 into a shield by pulling on the handle 54 in a direction down and away from the front end of the main barrel section 6 so as to pivot the barrel section 52 from the first position (depicted in FIG. 3A) into the second, shield position (depicted in FIG. 3B), where the barrel section 52 is further divided into the two generally symmetrical sub-sections 53 that are aligned transverse the lengthwise dimension of the main barrel section 6. This enhances play of the launcher 2, where the front section 50 is converted from an extended barrel for the launcher 2 into a shield that allows the user to still launch projectiles from the main barrel section 6 while being shielded from projectiles or other objects being launched at the user.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Further, although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

I claim:

1. A projectile launcher comprising:

a housing including a launching section, the launching section comprising a first spring and a second spring, a piston coupled with the first and second springs, and a charger that compresses each of the first and second springs against the piston within the launching section, and each of the first and second springs are disposed along a separate axis;

a hollow barrel that extends to a front end of the projectile launcher; a projectile loading area configured to receive and load a projectile in position with a firing end of the piston and the barrel;

a trigger;

wherein the charger comprises a charging lever that when moved in a direction toward a rear end of the housing, compresses the first spring and, when subsequently moved in a direction toward a front end of the housing, compresses the second spring; and wherein compression of the first and second springs by the charger is released in response to actuation of the trigger, and release of the compression of the first and second springs forces movement of the piston toward the projectile loading area so as to launch a projectile loaded within the projectile loading area through the barrel and from the projectile launcher.

2. The projectile launcher of claim 1, wherein the piston includes a first spring support that supports the first spring and a second spring support that supports the second spring.

3. The projectile launcher of claim 1, further comprising:

an extended barrel section that is coupled with the barrel, wherein the extended barrel section is configured for alignment in a first position in relation to the housing and a second position in relation to the housing that differs from the first position.

4. The projectile launcher of claim 3, wherein the extended barrel section expands to a shield configuration that extends transverse to the barrel in the second position.

5. A projectile launcher comprising:

a housing having a rear end and a front end, the housing including a launching section with a first spring and a second spring, a piston coupled with each of the first spring and the second spring, and a charger that compresses each of the first spring and the second spring against the piston and along a different axis within the launching section;

a barrel coupled to the housing;

a projectile loading area into which a projectile can be loaded;

a trigger coupled to the housing; and a charging lever coupled to the housing, the charging lever compresses the first spring when moved in a direction toward the rear end of the housing and compresses the second spring when subsequently moved in a direction toward the front end of the housing, the first spring and the second spring are released in response to actuation of the trigger, and the release of the first spring and the second spring forces movement of the piston toward the projectile loading area to launch a projectile loaded within the projectile loading area through the barrel and from the projectile launcher.

6. The projectile launcher of claim 5, wherein the piston includes a first spring support that supports the first spring and a second spring support that supports the second spring.

7. The projectile launcher of claim 5, further comprising:

an extended barrel section that is coupled with the barrel, wherein the extended barrel section is configured for alignment in a first position in relation to the housing and a second position in relation to the housing that differs from the first position.

8. The projectile launcher of claim 7, wherein the extended barrel section expands to a shield configuration that extends transverse to the barrel in the second position.

9. A projectile launcher comprising:

a housing having a rear end and a front end opposite the rear end, the housing including a first spring and a second spring, a piston coupled with each of the first spring and the second spring, and a charger that compresses each of the first spring and the second spring against the piston in the housing, the first spring being compressed along an axis and the second spring being compressed along an axis different from the axis along which the first spring is compressed;

a trigger coupled to the housing; and a charging lever movably coupled to the housing, the charging lever compresses the first spring when the charging lever is moved in a first direction and compresses the second spring when the charging lever is moved in a second direction, the first spring and the second spring are released in response to actuation of the trigger, and the release of the first spring and the second spring forces movement of the piston toward a projectile loading area to launch a projectile from the projectile launcher.

10. The projectile launcher of claim 9, wherein charging lever compresses the first spring when the charging lever is moved toward the rear end of the housing and compresses the second spring when the charging lever is moved toward the front end of the housing.

11. The projectile launcher of claim 10, wherein the charging lever can be moved toward the rear end of the housing after the charging lever is moved toward the front end of the housing.

* * * * *